US008903291B2

(12) United States Patent
Maruko

(10) Patent No.: US 8,903,291 B2
(45) Date of Patent: Dec. 2, 2014

(54) FIXING UNIT AND IMAGE FORMING APPARATUS EQUIPPED THEREWITH

(71) Applicant: Masami Maruko, Tokyo (JP)

(72) Inventor: Masami Maruko, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 47 days.

(21) Appl. No.: 13/753,972

(22) Filed: Jan. 30, 2013

(65) Prior Publication Data

US 2013/0202331 A1 Aug. 8, 2013

(30) Foreign Application Priority Data

Feb. 3, 2012 (JP) ..... 2012-021667

(51) Int. Cl.
*G03G 15/20* (2006.01)

(52) U.S. Cl.
CPC ..... *G03G 15/2085* (2013.01); *G03G 15/2035* (2013.01); *G03G 15/2028* (2013.01)
USPC ..... 399/323

(58) Field of Classification Search
USPC ..... 399/124, 323
See application file for complete search history.

(56) References Cited

U.S. PATENT DOCUMENTS 7,747,205 B2 * 6/2010 Fujii ..... 399/323
7,751,767 B2 * 7/2010 Burton et al. ..... 399/323

FOREIGN PATENT DOCUMENTS

JP 2011-242429 1/2011
JP 2011-191521 9/2011
JP 2011-242429 * 12/2011

OTHER PUBLICATIONS

Japanese Office Action, Japanese Patent Application No. 2012-021667, Dispatch Date: Jan. 21, 2014 (2 pages).
English translation of Japanese Office Action, Japanese Patent Application No. 2012-021667, Dispatch Date: Jan. 21, 2014 (2 pages).

* cited by examiner

*Primary Examiner* — Sandra Brase
(74) *Attorney, Agent, or Firm* — Lucas & Mercanti, LLP

(57) ABSTRACT

When an arm member 50 moves a pressure roller 36 away from a fixing roller 33, a guide mechanism 60 moves an air nozzle 40 in synchronization with the motion of the arm member 50 in order that a nozzle tip 40*a* moves an operating position near a fixing nip portion NP and a parking position to which the nozzle tip 40*a* is retracted from the operating position.

6 Claims, 7 Drawing Sheets

FIXING UNIT AND IMAGE FORMING APPARATUS EQUIPPED THEREWITH

CROSS-REFERENCE TO RELATED APPLICATIONS

The present application claims priority under 35 U.S.C. §119 to Japanese Patent Application No. P2012-021667, filed Feb. 3, 2012. The contents of this application are herein incorporated by reference in their entirety.

FIELD OF INVENTION

The present invention relates to a fixing unit for use in an image forming apparatus such as a copying machine, a printer, a facsimile machine, or a multi-functional peripheral chat combines the functions thereof, and an image forming apparatus equipped with this fixing unit.

DESCRIPTION OF RELATED ART

The image forming apparatus transfers a toner image to a sheet for forming the image on the sheet. The toner images is then fixed to the sheet by passing the sheet through a fixing nip portion of the fixing unit in the image forming apparatus.

Namely, at this portion, pressure and heat are applied to the sheet which is passing through this portion such that the toner images is fixed. Because of this, the printed surface of the sheet tends to adhere to a fixing roller and can be caught with it.

To deal with this shortcoming, an image forming apparatus is proposed, for example, as described in Japanese Patent Published Application No 2011-191521. This image forming apparatus is provided with an air nozzle in the vicinity of a fixing nip portion in the downstream side of the fixing nip portion to blow air toward the leading edge of the sheet passed through the fixing nip portion such that the sheet can come off from the fixing roller.

The image forming apparatus described in Japanese Patent Published Application No. 2011-191521 maintains the relative position between a fixing roller and a nozzle tip in the radial direction of the fixing roller by allowing the air nozzle to pivot around the fixing roller. By this configuration, the blowing position is adjusted to an appropriate position for separation in accordance with the paper type.

When a paper jam occurs at the fixing nip portion, the image forming apparatus rotates the air nozzle to a position where the nozzle tip is located far away from the fixing nip portion such that a jam clearing operation becomes easy.

However, since it is difficult to clear a paper jam occurring between the fixing roller and the nozzle tip in this image forming apparatus, the jam clearing operation may result in damage to the friction surface of the fixing roller or the nozzle tip.

SUMMARY OF THE INVENTION

To achieve at least one of the abovementioned objects, a fixing unit reflecting one aspect of the present invention comprises: a fixing roller; a pressure roller configured to form a fixing nip portion by engaging with said fixing roller under pressure; and an air nozzle located near said fixing nip portion in the paper discharge side of said fixing nip portion to blow paper separating air toward the leading edge of a sheet, which is passed through said fixing nip portion, wherein said pressure roller is able to move into and out of engagement with said fixing roller as engagement/disengagement motion, and wherein the nozzle tip of said air nozzle is able to move between an operating position near said fixing nip portion and a parking position to which the nozzle tip is retracted from the operating position in synchronization with the engagement/disengagement motion of said pressure roller.

To achieve at least one of the abovementioned objects, an image forming apparatus reflecting another aspect of the present invention comprises: an image forming unit configured to form a toner image on a sheet; and a fixing unit configured to fix the toner image formed on the sheet, and said fixing unit comprises: a fixing roller; a pressure roller configured to form a fixing nip portion by engaging with said fixing roller under pressure; and an air nozzle located near said fixing nip portion in the paper discharge side of said fixing nip portion to blow paper separating air toward the leading edge of a sheet which is passed through said fixing nip portion, wherein said pressure roller is able to move into and out of engagement with said fixing roller as engagement/disengagement motion, and wherein the nozzle tip of said air nozzle is able to move between an operating position near said fixing nip portion and a parking position to which the nozzle tip is retracted from the operating position in synchronization with the engagement/disengagement motion of said pressure roller.

DETAILED DESCRIPTION OF THE PREFERRED EMBODIMENT

Hereinafter, a description is given of embodiments of the present invention with reference to the drawings.

Figure 1:
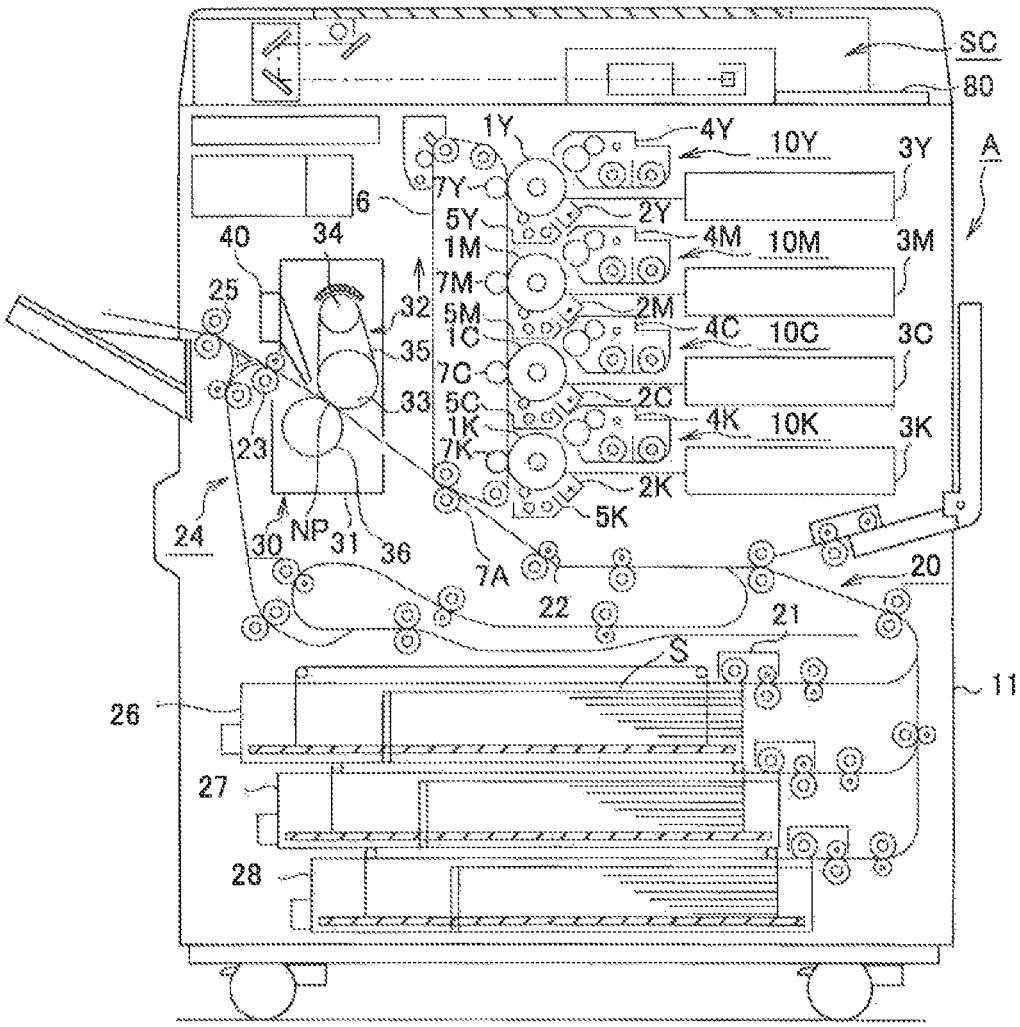
FIG. 1 is a view for schematically showing the overall configuration of an image forming apparatus according to the present invention.

FIG. 1 shows a so-called image forming apparatus A which performs image formation with four sets of image forming units.

An original is placed on an original placement tray and exposed and scanned by an optical system of a scanning exposing device of an image reading apparatus SC. Light reflected from the exposed and scanned original is read as an image information signal by a line image sensor through photoelectrically conversion. An image processing unit processes the image information signal by performing an analog process, A/D conversion, shading compensation, image data compression and so on, and outputs the processed image information signal to an optical writing unit of each image forming unit.

The four sets of image forming units are an image forming unit 10Y for forming yellow (Y) images, an image forming unit 10K for forming magenta (M) images, an image forming unit 10C for forming cyan (C) color images, and an image forming unit 10K for forming black (K) images. These image forming units are given a common reference number 10 with suffix characters Y, K, C and K respectively attached to indicate colors for forming images. The suffix characters are sometimes omitted here to describe common features for convenience.

The image forming unit 10Y is provided with a photoreceptor drum 1Y, and a electrostatic charging unit 2Y, an optical writing unit 3Y, a developing unit 4Y and a drum cleaner 5Y which are arranged adjacent to the photoreceptor drum 1Y.

Also, like the image forming unit 10Y, the other image forming units 10K, 10C and 10K are provided with photoreceptor drums 1M, 1C and 1K, and electrostatic charging units 2M, 2C and 2K, optical writing units 3M, 3C and 3K, developing units 4M, 4C and 4K, drum cleaners 5M, 5C and 5K.

Each image forming unit 10 writes an image information signal on the photoreceptor drum 1 by the optical writing unit 3 to form a latent image. The latent image is developed by the developing unit 4 to form a toner image on the photoreceptor drum 1 as a visible image.

Namely, yellow (Y), magenta (M), cyan (C) and black (K) color images are formed on the photoreceptor drums 1Y, 1M, 1C and 1K of the image forming units 10Y, 10M, 10C and 10K respectively.

An intermediate transfer belt 6 is extending around and rotatably supported by the plurality of rollers.

The toner images of these colors are successively transferred on the intermediate transfer belt 6 by first transfer units 7Y, 7M, 7C and 7K to form a color image with yellow (Y), magenta (M), cyan (C) and black (K) colors superimposed together.

A paper feed unit 20 is used to convey sheets S. The sheets S are stored in paper feed trays 26, 27 and 28. The paper feed trays 26, 27 and 28 are removably placed in the lower portion of a housing 11. The sheets S are fed from a first paper feed unit 21, conveyed through a resist roller 22, and passed to a second transfer unit 7A where color images are transferred to the sheets S from the intermediate transfer belt 6. The sheets S with the color images transferred are heated and pressed by a fixing unit 30. By this process, the toner images are fixed to the sheets S which are then discharged out of the image forming apparatus A through a fixing conveyance roller 23 and a discharging roller 25.

The image forming apparatus A is also provided with a sheet reversing unit 24. The image forming apparatus A directs the fixed sheet S from the fixing conveyance roller 23 to the sheet reversing unit 24 to reverse the front and back sides of the sheet S, followed by discharging the reversed sheet through the discharging roller 25. Alternatively, the image forming apparatus A may refeed the fixed sheet S to the upstream of the image forming unit 10 for forming images on both sides of the sheet S.

Users can operate this image forming apparatus A for forming images through a manipulation display 80 provided on the top of the housing thereof.

The fixing unit 30 as described above is a be nip type fuser provided with a fixing belt unit 32 and a pressure roller 36 in a housing 31 of the unit. The pressure roller 36 and the fixing belt unit 32 are in contact with each other and urged against each other to form a fixing nip portion NP therebetween.

The fixing belt unit 32 is provided with a fixing roller 33, a heat roller 34 and a fixing belt 35. The fixing belt 35 extends around both the rollers 33 and 34.

The sheet S is conveyed and passed through the fixing nip portion NP such that the surface of the sheet S on which an image is fixed is facing the fixing belt unit 32 during conveyance. By this configuration, the image is fixed to the surface of the sheet S on which an image is fixed by applying a pressure between the pressure roller 36 and the fixing roller 33 of the fixing belt unit 32, and heat effects from the fixing belt 35.

The air nozzle 40 is arranged near the fixing nip portion NP in the paper discharge side. The air nozzle 40 blows air toward the leading edge of the sheet S passed through the fixing nip portion NP such that the sheet can come off from the fixing belt 35.

Next, the structure of the fixing unit 30 will be described below in detail with reference to FIG. 2 through FIG. 7.

Figure 2:
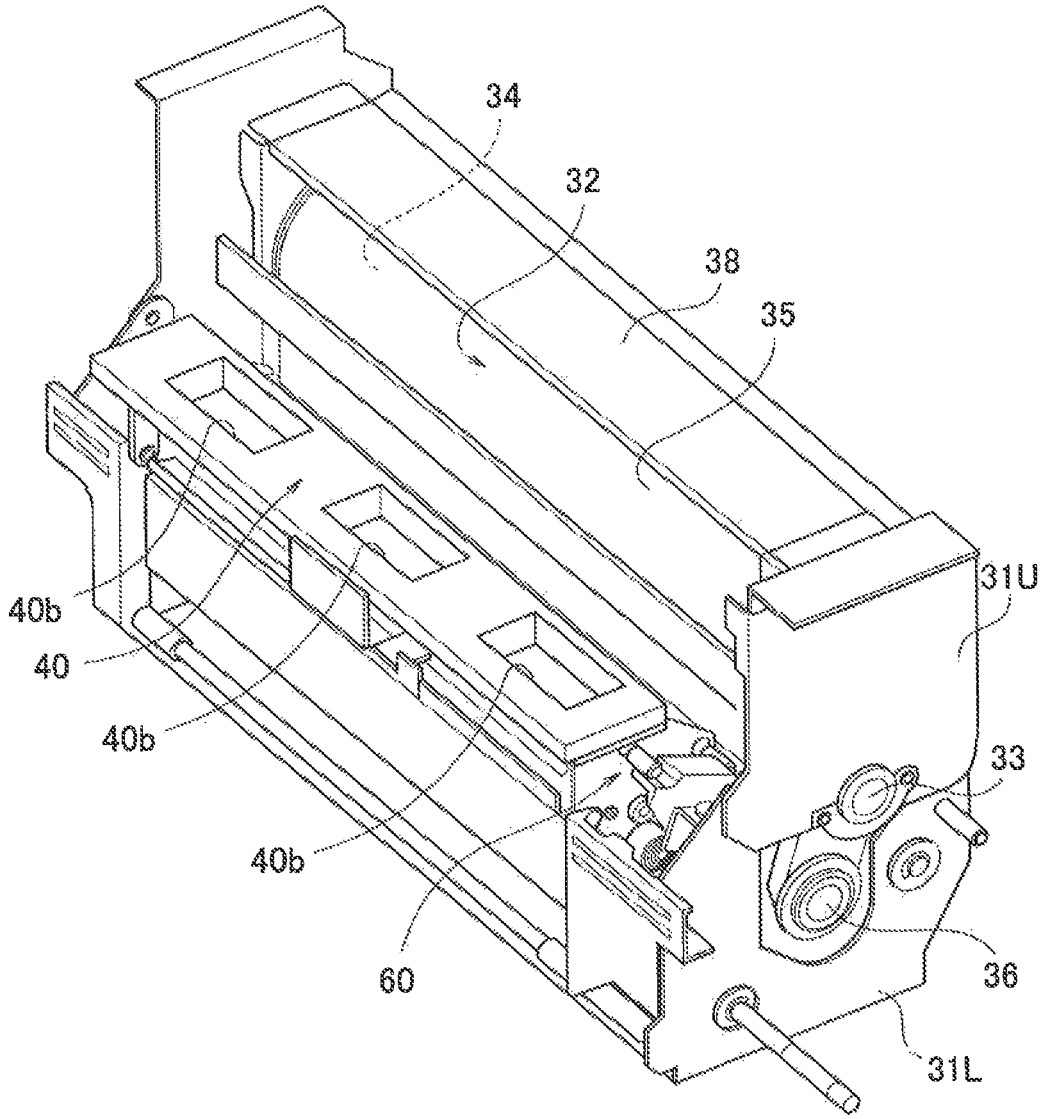
FIG. 2 is a perspective external view for showing an embodiment of the fixing unit according to the present invention.

As shown in FIG. 2, the housing 31 is divided into a upper housing 31U and a lower housing 31L. The fixing belt unit 32 is contained in the upper housing 31U. The pressure roller 36 and the air nozzle 40 are arranged in the lower housing 31L.

Figure 4:
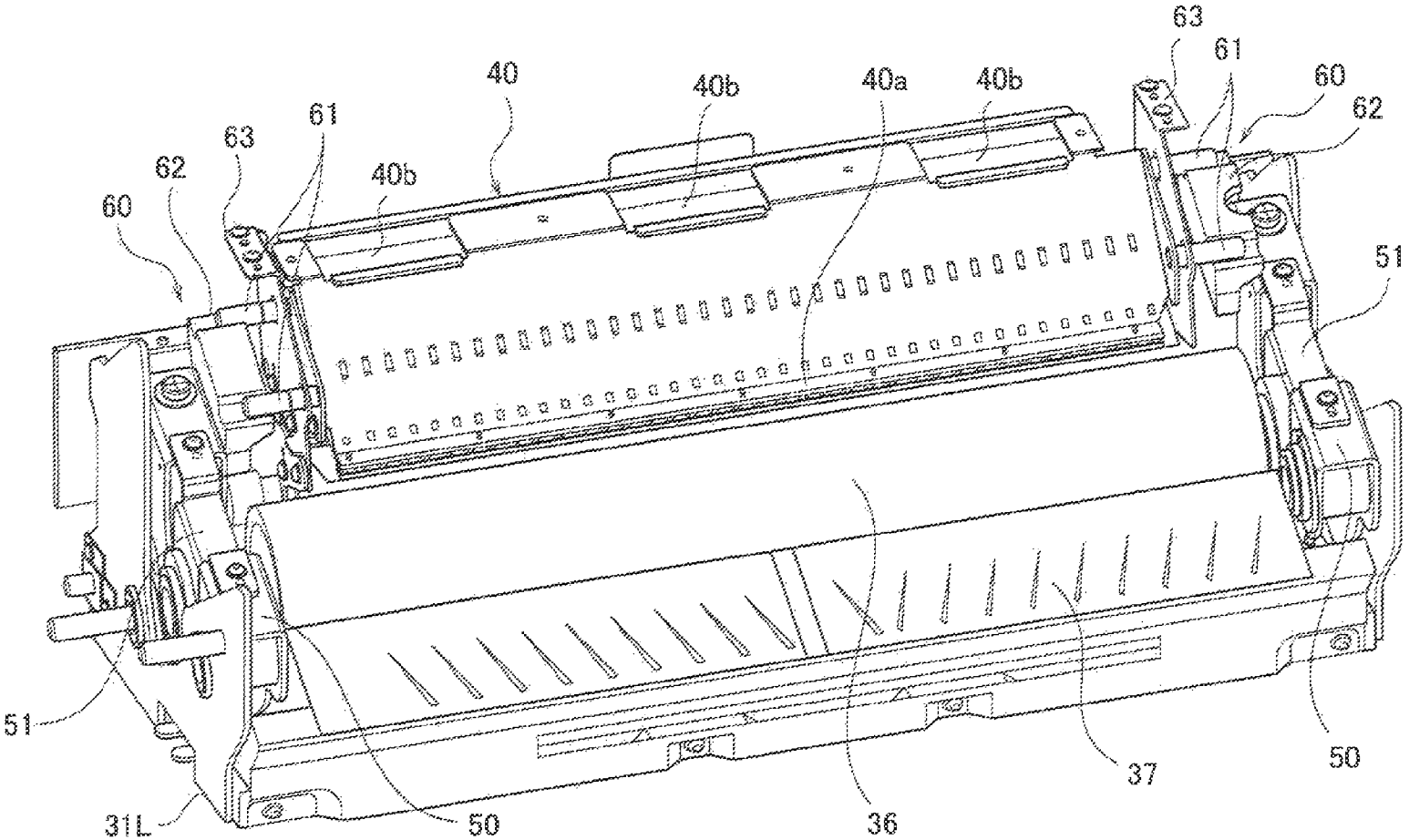
FIG. 4 is a perspective view for showing the arrangement of a pressure roller and an air nozzle in the fixing unit as illustrated in FIG. 2.

The upper housing 31U and the lower housing 31L are separated with a paper insertion slot located therebetween but not shown in the figure. The lower housing 31L is provided with a guide slope 37 which guides the sheet S to the fixing nip portion NP through the paper insertion slot as shown in FIG. 4.

When the upper housing 31U and the lower housing 31L are disassembled, the fixing belt unit 32 and the pressure roller 36 can be attached to and detached from the housings 31U and 31L respectively. Because of this, the fixing belt unit 32 and the pressure roller 36 can be easily replaced.

Figure 3:
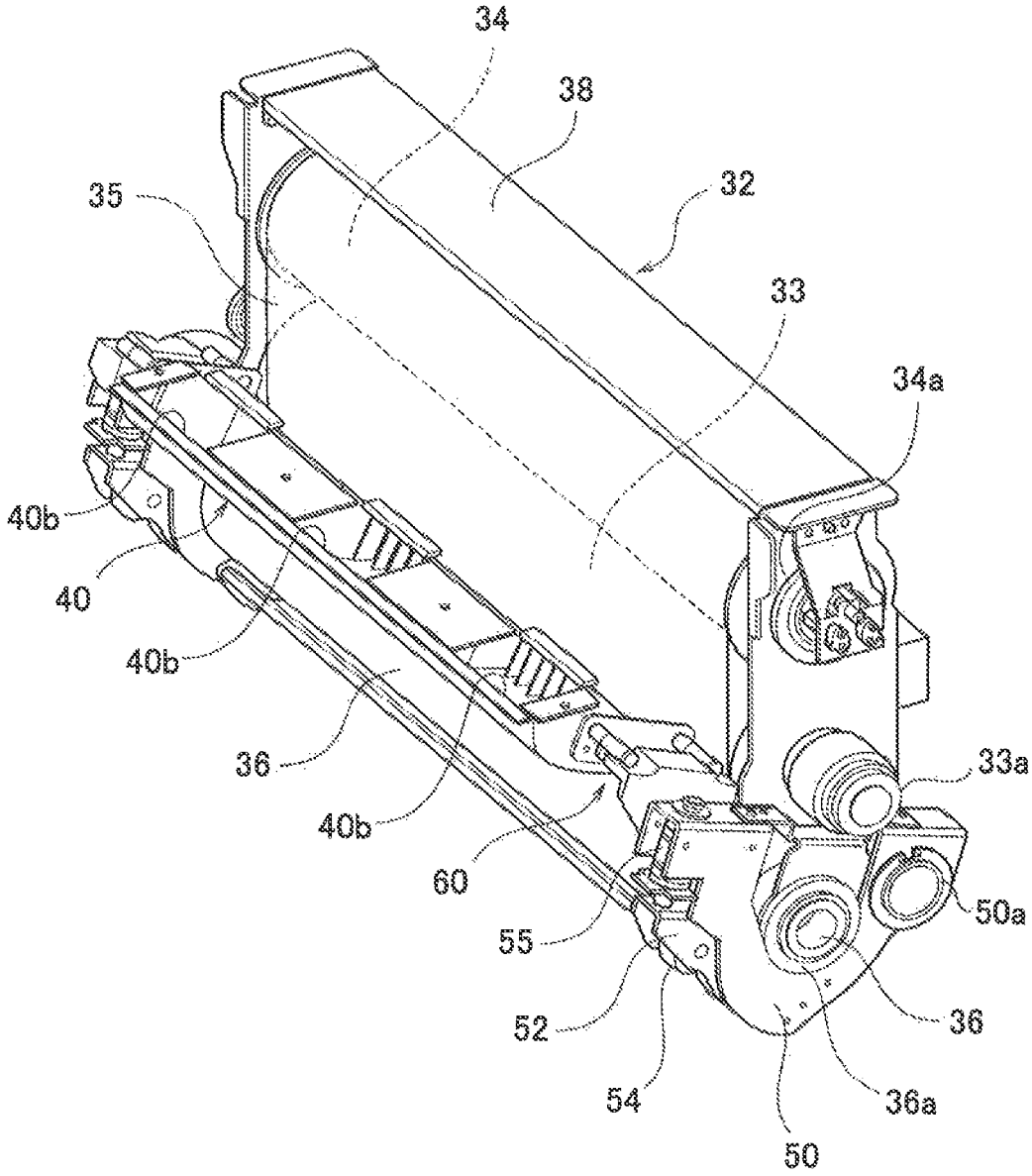
FIG. 3 is a perspective view for showing the internal structure of the fixing unit by removing a housing of the unit.

As shown in FIG. 3, the fixing belt unit 32 is subassembled on a subordinate support frame 38, and can be attached to and detached from the upper housing 31U together with this subordinate support frame 38.

In the case shown in FIG. 3, the heat roller 34 is rotatably supported on the subordinate support frame 38 with both ends through bearings 34*a*. Also, the fixing roller 33 is rotatably supported on the upper housing 31U with both ends through bearings 33*a*.

When the upper housing 31U and the lower housing 31L are assembled, the pressure roller 36 is supported such that it can move into and out of engagement with the fixing roller 33.

Figure 5:
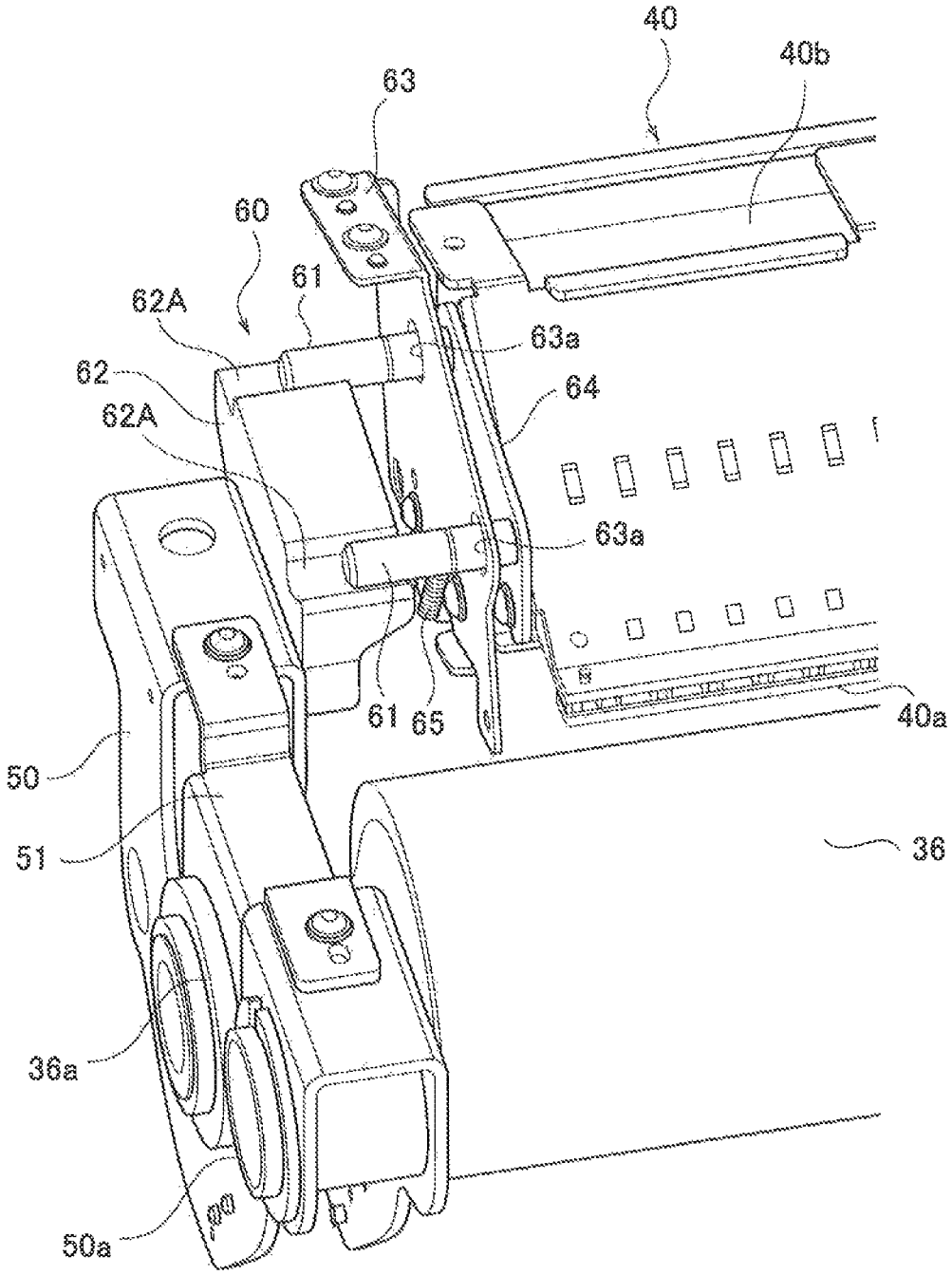
FIG. 5 is a perspective view for showing the key parts of FIG. 4.

More specifically speaking, as shown in FIG. 4 and FIG. 5, an arm member 50 which is nearly U-shaped in a side view is rotatably supported on each of the inner surfaces of side walls of the lower housing 31L through a support shaft 50*a*.

The arm member 50 is provided with upper walls both at the rotation axis side end and the free end respectively as shown also in FIG. 5. Side walls joined to each upper wall are spaced with a predetermined distance therebetween. Accordingly, the arm member 50 includes a double-wall structure.

The pressure roller 36 is rotatably supported across the inner and outer walls of the arm member 50 at each end. Specifically speaking, the pressure roller 36 is mounted at each end on a U-shaped groove of the arm member 50 through a bearing 36*a* and a retainer 51 which holds the bearings 36*a*.

The retainer 51 is fixed by brackets screwed into both the upper walls of the arm member 50 in the free and rotation axis side ends respectively (refer to FIG. 5).

Figure 7:
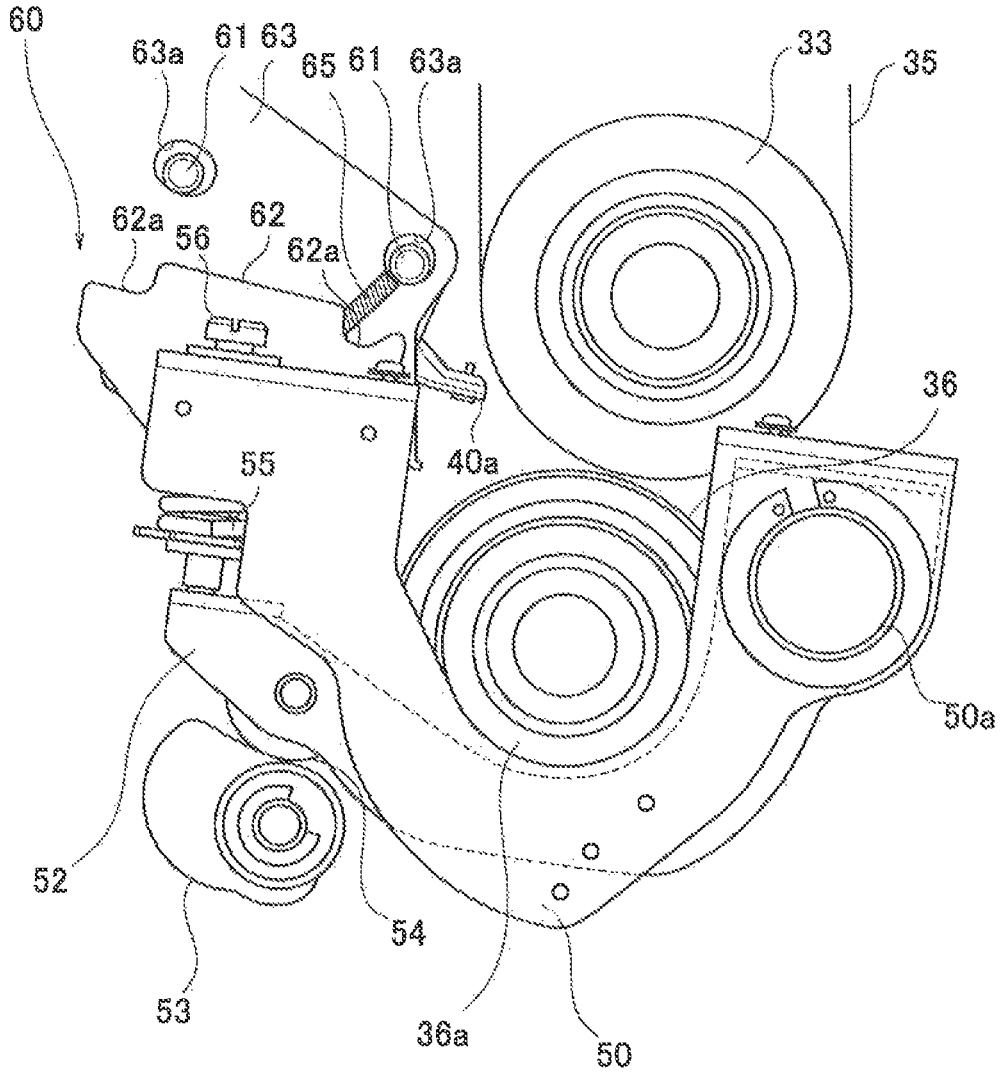
FIG. 7 is an explanatory side view for showing the disengagement positions of the fixing roller and the pressure roller.

A pivot arm 52 is pivotally mounted on the support shaft 50*a* of the arm member 50 between the inner and outer walls of the arm member 50 (refer to FIG. 5 and FIG. 7).

The pivot arm 52 is located below the bearing 36*a* so as not to touch the bearing 36*a* at each end of the pressure roller 36. A roller type cam follower 54 is provided at the free end of the pivot arm 52 to be in contact with a drive cam 53. The drive cam 53 is pivotally mounted on the lower housing 31L.

A coil spring 55 is interposed between the free end of the arm member 50 and the free end of the pivot arm 52. The coil spring 55 urges these free ends apart from each other.

The pressure roller 36 can move into and out of engagement with the fixing roller 33 through the pivot arm 52 and the arm member 50 by rotating the drive cam 53.

The roller engagement pressure at the fixing nip portion NP is freely adjustable by adjusting the spring force of the coil spring 55 through an adjust screw 56.

The air nozzle 40 becomes movable to its operating position where the tip 40*a* of the air nozzle 40 is located near the fixing nip portion NP or its parking position to which the tip 40*a* is retracted from the operating position, in synchronization with the engagement/disengagement motion of the pressure roller 36, i.e., which is coming in contact with or moving away from the pressure roller 36.

The air nozzle 40 is formed in a substantially box-like shape with a length which is substantially equal to the effective width of the fixing nip portion NP. A fan unit, which is not shown in the figure, is provided for a plurality of openings 40*b* formed on the upper end surface of the air nozzle 40.

The air nozzle 40 is attached to the housing 31L such that a guide mechanism 60 guides the motion of the nozzle tip 40*a* between the operating position and the parking position.

The guide mechanism 60 is provided with a plurality of nozzle support pins 61, a guide member 62 and a support frame 63 in each side (refer to FIG. 4 and FIG. 5). The plurality of nozzle support pins 61 laterally protrude from each opposite side of the air nozzle 40. While the pressure roller 36 comes in contact with the fixing roller 34, the guide member 62 guides the nozzle tip 40*a* to the operating position by supporting the nozzle support pins 61. While the pressure roller 36 is located apart from the fixing roller 34, the support frame 63 guides the nozzle tip 40*a* to the parking position by supporting the nozzle support pins 61.

The nozzle support pins 61 protrude from a pin plate 64. The pin plate 64 is fixed to each side surface of the air nozzle 40 through screws.

The guide member 62 is fixed to the inner wall of the free end of the arm member 50 through screws. The guide member 62 is provided with a plurality of guide grooves 62A formed on its upper surface for supporting the bottoms of the ends of the nozzle support pins 61.

The support frame 63 is formed to extend from the lower housing 31L. The support frame 63 is provided with a plurality of through-holes 63*a* in positions corresponding to the nozzle support pins 61 such that the nozzle support pins 61 are loosely inserted through the through-holes 63*a*. The support frame 63 guides the nozzle tip 40*a* to the parking position by engaging with the nozzle support pins 61 at the lower edges of the through-holes 63*a*.

When the nozzle tip 40*a* is retracted into in the parking position where it does not block the paper path in the downstream side of the fixing nip portion NP during a jam clearing operation of the sheet S to be described below.

A coil spring 65 is provided as a spring member between the support frame 63 and the pin 61 near the nozzle tip 40*a* of the plurality of nozzle support pins 61. The coil spring 65 is pulled or extended between the support frame 63 and the pin 61 from its free state to urge the nozzle support pin 61 toward the guide member 62.

Figure 6:
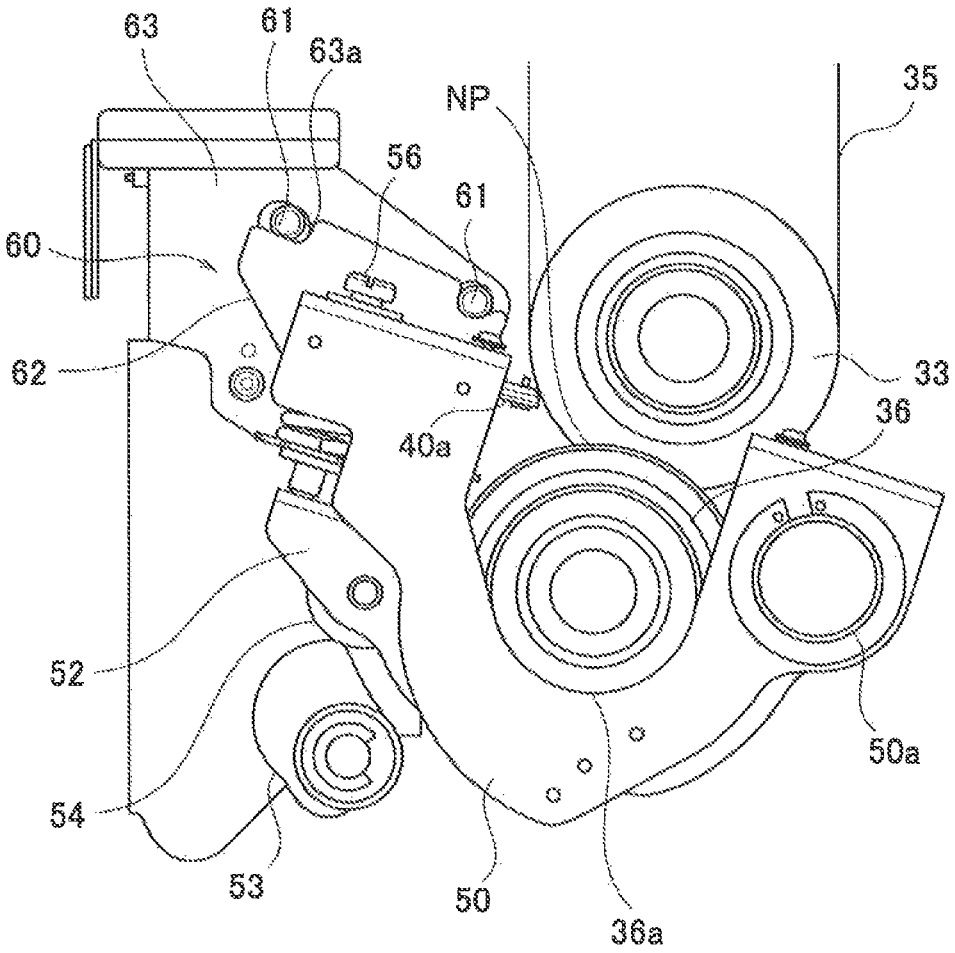
FIG. 6 is an explanatory side view for showing the engagement positions of the fixing roller and the pressure roller.

In accordance with the fixing unit 30 of the present embodiment having the structure as described above, when paper jam occurs at the fixing nip portion NP or between the fixing roller 33 and the nozzle tip 40*a* of the air nozzle 40, the drive cam 53 is rotated to rotate the arm member 50 around the support shaft 50*a* by its own weight in the counter clockwise direction as illustrated in FIG. 6 and FIG. 7.

The pressure roller 36 thereby moves from the position engaging with the fixing roller 33 under pressure as illustrated in FIG. 6 to the position away from the fixing roller 33 as illustrated in FIG. 7.

In synchronization with the motion of the pressure roller 36 away from the fixing roller 33, the guide member 62 supporting the nozzle support pins 61 moves downwards together with the arm member 50. Then, the air nozzle 40 moves downwards by its own weight such that the nozzle tip 40*a* moves from the operating position near the fixing nip portion NP as illustrated in FIG. 6 to the parking position as illustrated in FIG. 7.

Accordingly, it is easy to conduct a jam clearing operation when jam occurs at the fixing nip portion NP and also when jam occurs between the fixing roller 33 and the nozzle tip 40*a* of the air nozzle 40. Because of this, it is possible to prevent damage from occurring to the friction surface of the fixing belt 35 or the nozzle tip 40*a*.

The air nozzle 40 of the present embodiment is guided by the guide mechanism 60 between the operating position and the parking position in synchronization with the engagement/disengagement motion of the pressure roller 36. Because of this the nozzle tip 40*a* can be moved in the position appropriate for air blow separation or the position appropriate for a jam clearing operation.

The guide mechanism 60 is a simplified structure for guiding the air nozzle 40 to the operating position by the use of the nozzle support pins 61 in the air nozzle 40 side and the guide member 62 in the lower housing 31L side for supporting the nozzle support pins 61. Accordingly, there are design and cost advantages.

The nozzle support pins 61 are loosely inserted through the through-holes 63*a* opened through the support frame 63 in the lower housing 31L side, and engage with the lower edges of the through-holes 63*a* to guide the nozzle tip 40*a* to the parking position. Because of this, the nozzle tip 40*a* is prevented from moving to the paper path in the downward direction such that a sufficient space is provided for conducting a jam clearing operation.

In addition, the coil spring 65 is provided between the nozzle support pin 61 and the support frame 63 in an extended state relative to its free state. It is therefore possible to guide the position of the nozzle tip 40*a* more definitely by controlling the motion of the nozzle tip 40*a* in the vertical direction between the operating position and the parking position. Accordingly, the interference between the nozzle tip 40*a* and the fixing belt 35 can be avoided.

Meanwhile, in the case of the aforementioned embodiment, the fixing unit is a belt nip type unit as illustratively described with the fixing belt unit. However, the present invention is not limited thereto but can be applied to a roller nip type fixing unit in which a fixing nip portion is formed between a fixing roller and a pressure roller.

Furthermore, while the guide mechanism 60 is used to control the motion of the air nozzle 40 in synchronization with the engagement/disengagement motion of the pressure roller 36, the motion control mechanism is not limited thereto as long as the air nozzle 40 can move between the operating position and the parking position in synchronization with the engagement/disengagement motion of the pressure roller 36.

What is claimed is:

1. A fixing unit comprising:

a fixing roller;

a pressure roller configured to form a fixing nip portion by engaging with said fixing roller under pressure;

an air nozzle having a nozzle tip located near said fixing nip portion in the paper discharge side of said fixing nip portion to blow paper separating air toward the leading edge of a sheet which is passed through said fixing nip portion, wherein said pressure roller is able to move into and out of engagement with said fixing roller as engagement/disengagement motion, wherein the nozzle tip of said air nozzle is able to move between an operating position near said fixing nip portion and a parking position to which the nozzle tip is retracted from the operating position in synchronization with the engagement/disengagement motion of said pressure roller; and a guide mechanism configured to guide the motion of said nozzle tip between said operating position and said parking position, said guide mechanism comprising a nozzle support pin which laterally protrudes from said air nozzle; and a guide member provided on a free end of an arm member performing the engagement/disengagement motion of said pressure roller, and configured to guide said nozzle support pin to said operating position by supporting said nozzle support pin at least in a position enabling engagement between said pressure roller and said fixing roller under pressure.

2. The fixing unit of claim 1 wherein said nozzle support pin is loosely inserted through a through-hole opened through a support frame formed on a housing of said fixing unit, and wherein said nozzle tip is guided to said parking position by engaging said nozzle support pin with the lower edge of said through-hole.

3. The fixing unit of claim 2 further comprising:

a spring member connected and expanded between said nozzle support pin and said support frame in order to urge said nozzle support pin toward said guide member.

4. The Image forming apparatus of claim 1, said fixing unit further comprising:

a spring member connected and expanded between said nozzle support pin and said support frame in order to urge said nozzle support pin toward said guide member.

5. An image forming apparatus comprising:

an image forming unit configured to form a toner image on a sheet; and a fixing unit configured to fix the toner image formed on the sheet, said fixing unit comprising:

a fixing roller;

a pressure roller configured to form a fixing nip portion by engaging with said fixing roller under pressure;

an air nozzle located near said fixing nip portion in the paper discharge side of said fixing nip portion to blow paper separating air toward the leading edge of a sheet which is passed through said fixing nip portion, wherein said pressure roller is able to move into and out of engagement with said fixing roller as engagement/disengagement motion, wherein the nozzle tip of said air nozzle is able to move between an operating position near said fixing nip portion and a parking position to which the nozzle tip is retracted from the operating position in synchronization with the engagement/disengagement motion of said pressure roller; and a guide mechanism configured to guide the motion of said nozzle tip between said operating position and said parking position, said guide mechanism comprising a nozzle support pin which laterally protrudes from said air nozzle; and a guide member provided on a free end of an arm member performing the engagement/disengagement motion of said pressure roller, and configured to guide said nozzle support pin to said operating position by supporting said nozzle support pin at least in a position enabling engagement between said pressure roller and said fixing roller under pressure.

6. The image forming apparatus of claim 5, wherein said nozzle support pin is loosely inserted through a through-hole opened through a support frame formed on a housing of said fixing unit, and wherein said nozzle tip is guided to said parking position by engaging said nozzle support pin with the lower edge of said through-hole.

* * * * *